US010309652B2

(12) United States Patent
Spence et al.

(10) Patent No.: US 10,309,652 B2
(45) Date of Patent: Jun. 4, 2019

(54) GAS TURBINE ENGINE COMBUSTOR BASKET WITH INVERTED PLATEFINS

(71) Applicant: SIEMENS ENERGY, INC., Orlando, FL (US)

(72) Inventors: Kevin J. Spence, Winter Springs, FL (US); Stephan J. Storms, Clover, SC (US)

(73) Assignee: SIEMENS ENERGY, INC., Orlando, FL (US)

( * ) Notice: Subject to any disclaimer, the term of this patent is extended or adjusted under 35 U.S.C. 154(b) by 973 days.

(21) Appl. No.: 14/251,679

(22) Filed: Apr. 14, 2014

(65) Prior Publication Data

US 2015/0292742 A1 Oct. 15, 2015

(51) Int. Cl.

| | |
|---|---|
| ***F23R 3/16*** | (2006.01) |
| ***F23R 3/00*** | (2006.01) |
| ***F23R 3/42*** | (2006.01) |

(52) U.S. Cl.

CPC ..... *F23R 3/16* (2013.01); *F23R 3/002* (2013.01); *F23R 3/42* (2013.01); *F23R 2900/03041* (2013.01); *F23R 2900/03042* (2013.01); *F23R 2900/03043* (2013.01); *F23R 2900/03044* (2013.01); *F23R 2900/03045* (2013.01)

(58) Field of Classification Search

CPC ..... F23R 3/002; F23R 2900/03041; F23R 2900/03042; F23R 2900/03043; F23R 2900/03044; F23R 2900/03045

See application file for complete search history.

(56) References Cited

U.S. PATENT DOCUMENTS

| | | | | |
|---|---|---|---|---|
| 3,736,747 A * | 6/1973 | Warren | F23R 3/002 60/730 |
| 4,296,606 A * | 10/1981 | Reider | F23R 3/002 219/101 |
| 4,361,010 A * | 11/1982 | Tanrikut | F23R 3/002 60/757 |
| 4,695,247 A | 9/1987 | Enzaki et al. | |
| 6,282,905 B1 * | 9/2001 | Sato | F23R 3/002 60/752 |
| 7,694,522 B2 * | 4/2010 | Nakae | F23R 3/002 60/752 |

(Continued)

OTHER PUBLICATIONS

Gas Turbine Combustion: Alternative Fuels and Emissions, Third Edition, Arthur H. Lefebvre and Dilip R. Ballal, CRC Press Taylor & Francis Group, 2010, p. 346 (available at: https://www.taylorfrancis.com/books/9781420086058).*

(Continued)

*Primary Examiner* — Gerald L Sung
*Assistant Examiner* — Marc J Amar

(57) ABSTRACT

A gas turbine engine combustor basket has nested outer and inner liners that are separated by a gap at their respective distal downstream ends for passage of cooling air between the liners. Radially inwardly projecting platefins formed on an inner circumferential surface of the outer liner maintain the cooling air passage gap. In some embodiments effusion cooling through holes are formed in the inner liner outer circumference, oriented in the air passage gap between the fins, so that cooling air passes through the effusion holes into the cooling air passage gap.

10 Claims, 4 Drawing Sheets

(56) References Cited

U.S. PATENT DOCUMENTS 7,802,431 B2 * 9/2010 Parker ..... F23R 3/002 60/752
8,661,827 B2 * 3/2014 Morimoto ..... B23K 1/0018 29/463
9,212,823 B2 * 12/2015 Boardman ..... F23R 3/286
2003/0000219 A1 1/2003 Tiemann
2005/0047932 A1 * 3/2005 Nakae ..... F23R 3/002 417/313
2007/0062199 A1 * 3/2007 Cowan ..... F02K 1/1223 60/770
2009/0277180 A1 * 11/2009 Lam ..... F23R 3/002 60/752
2010/0005804 A1 1/2010 Chen et al.
2010/0111675 A1 * 5/2010 Wojtyczka ..... F04D 29/023 415/119
2012/0102916 A1 * 5/2012 Bunker ..... F02C 5/11 60/247
2012/0167574 A1 * 7/2012 Uskert ..... F23M 5/02 60/754
2012/0169326 A1 * 7/2012 Krishna ..... F23M 5/02 324/240
2012/0198854 A1 * 8/2012 Schilp ..... F23R 3/002 60/755
2012/0255308 A1 * 10/2012 Chandler ..... F23R 3/002 60/754
2012/0304654 A1 * 12/2012 Melton ..... F23R 3/002 60/746
2013/0180252 A1 * 7/2013 Chen ..... F23R 3/002 60/754
2014/0060063 A1 * 3/2014 Boardman ..... F23R 3/286 60/772
2015/0047313 A1 * 2/2015 Maurer ..... F23R 3/002 60/39.48
2015/0369486 A1 * 12/2015 Yokota ..... F15D 1/009 60/754
2016/0069566 A1 * 3/2016 Numata ..... F23R 3/002 60/752
2016/0131365 A1 * 5/2016 Tu ..... B64D 27/10 60/755
2017/0089580 A1 * 3/2017 Hu ..... F23R 3/002
2018/0259183 A1 * 9/2018 Fetvedt ..... F02B 43/12

OTHER PUBLICATIONS

Jane's Aero-Engines, Issue Seven, Edited by Bill Gunston, Jane's Information Group Inc., Alexandria, Virginia, 2000, pp. 1-47 and 510-512.*

* cited by examiner

GAS TURBINE ENGINE COMBUSTOR BASKET WITH INVERTED PLATEFINS

BACKGROUND OF THE INVENTION

1. Field of the Invention

The invention relates to combustor baskets for gas turbine engine combustors. More particularly, the invention relates to combustor baskets of the type having nested inner and outer liners separated by a cooling air gap.

2. Description of the Prior Art

Some known types of gas turbine engines having annular combustor construction incorporate combustor baskets with nested inner and outer liners, separated by a cooling air gap. The cooling air gap is maintained at the distal downstream tip of the basket by radially outwardly directed dimples formed in the inner basket distal tip that abut against the outer liner. A standoff gap is preserved between the respective liners so long as the dimples maintain structural integrity. The inner liner is in direct communication with the combusted gas flow, experiencing higher temperature exposure than the outer liner. The combustion gas thermal and fluid contact erodes and/or distorts the inner basket during engine operation. In some operating environments dimples formed on the inner liner distal tip erode or collapse, facilitating collapsing of the cooling gap between the inner and outer liners. Diminished cooling flow hastens further thermal erosion of the combustion basket. In an effort to improve cooling airflow in the combustor basket gap between the inner and outer liners, some combustor basket designs have incorporated through holes in the inner liner circumference, especially proximal the basket distal tip portion, in order to induce radial airflow into the gap as well as axial airflow.

SUMMARY OF THE INVENTION

Accordingly, a suggested object of embodiments of the invention is to maintain combustor basket cooling airflow in the gap between inner and outer liners during operation of the gas turbine engine.

Another object of embodiments of the invention is to maintain the invention is to combustor basket cooling airflow in the gap between inner and outer liners during operation of the gas turbine engine while preserving the option of forming cooling air through holes in the inner liner.

Yet another object of embodiments of the invention is to enhance combustor basket service life by maintaining combustor basket cooling airflow in in the gap between inner and outer liners during operation of the gas turbine engine.

These and other objects are achieved in one or more embodiments of the invention by a gas turbine engine combustor basket, which has nested outer and inner liners that are separated by a gap at their respective distal downstream ends for passage of cooling air between the liners. Radially inwardly projecting platefins formed on an inner circumferential surface of the outer liner maintain the cooling air passage gap. In some embodiments effusion cooling through holes are formed in the inner liner outer circumference, oriented in the air passage gap between the fins, so that cooling air passes through the effusion holes into the cooling air passage gap. By locating the platefins on the outer liner they are less susceptible to thermal erosion and distortion than previously known liner separation constructions that were located on the inner liner. Locating the platefins on the outer liner also facilitates inclusion of cooling through holes on the inner liner between the corresponding outer liner platefins, so that additional radial cooling flow is introduced into the gap between the liners. Combustor basket service life is enhanced by maintaining cooling airflow gap between the inner and outer liners.

Other embodiments of the invention feature a gas turbine engine including a turbine casing, which in turn includes therein a rotatable rotor as well as compressor, combustor and turbine sections. The combustor section has a plurality of nested outer and inner liners, respectively having axial length and radially spaced downstream distal ends. The respective liners form a gap between themselves for passage of cooling air. Radially inwardly projecting platefins formed on an inner circumferential surface of each of the outer liners maintains the cooling air passage gap.

Additional embodiments of the invention feature method for cooling a gas turbine engine combustor basket, for passage of combustion gas there through. The method includes the steps of providing nesting outer and inner liners, respectively having axial length and radially spaced downstream distal ends; and forming radially inwardly projecting platefins on an inner circumferential surface of the outer liner. The inner liner is nested within the outer liner, so that distal tips of the platefins abut an outer circumference of the inner liner distal end, thereby forming a cooling air passage gap between the respective liners, for passage of cooling air. The combustor basket is installed within a gas turbine combustor. The engine is operated, so that cooling air passes through the cooling air passage gap.

The respective objects and features of the present invention may be applied jointly or severally in any combination or sub-combination by those skilled in the art.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

After considering the following description, those skilled in the art will clearly realize that the teachings of embodiments of the invention can be readily utilized in a gas turbine engine combustor basket, which has nested outer and inner liners that are separated by a gap at their respective distal downstream ends for passage of cooling air between the liners. Radially inwardly projecting platefins formed on an inner circumferential surface of the outer liner maintain the cooling air passage gap. In some embodiments effusion cooling through holes are formed in the inner liner outer circumference, oriented in the air passage gap between the fins, so that cooling air passes through the effusion holes into the cooling air passage gap. By locating the platefins on the outer liner they are less susceptible to thermal erosion and distortion than previously known liner separation constructions that were located on the inner liner. Locating the platefins on the outer liner also facilitates inclusion of cooling through holes on the inner liner between the corresponding outer liner platefins, so that additional radial cooling flow is introduced into the gap between the liners.

Figure 1:
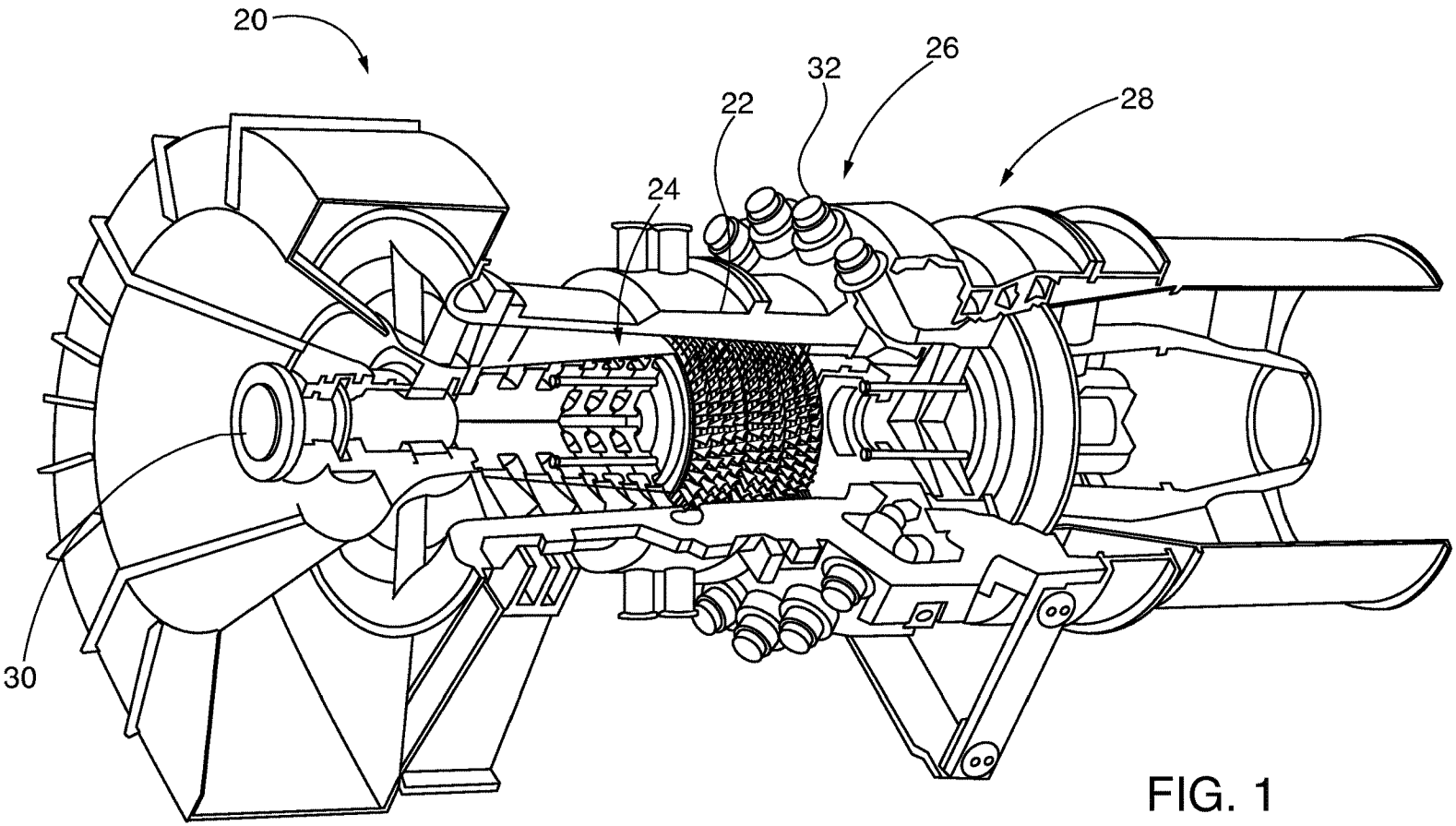
FIGS. 1 and 2 are axial cross sectional views of a gas turbine engine incorporating an embodiment of a combustor including a combustor basket of the invention.
Figure 2:
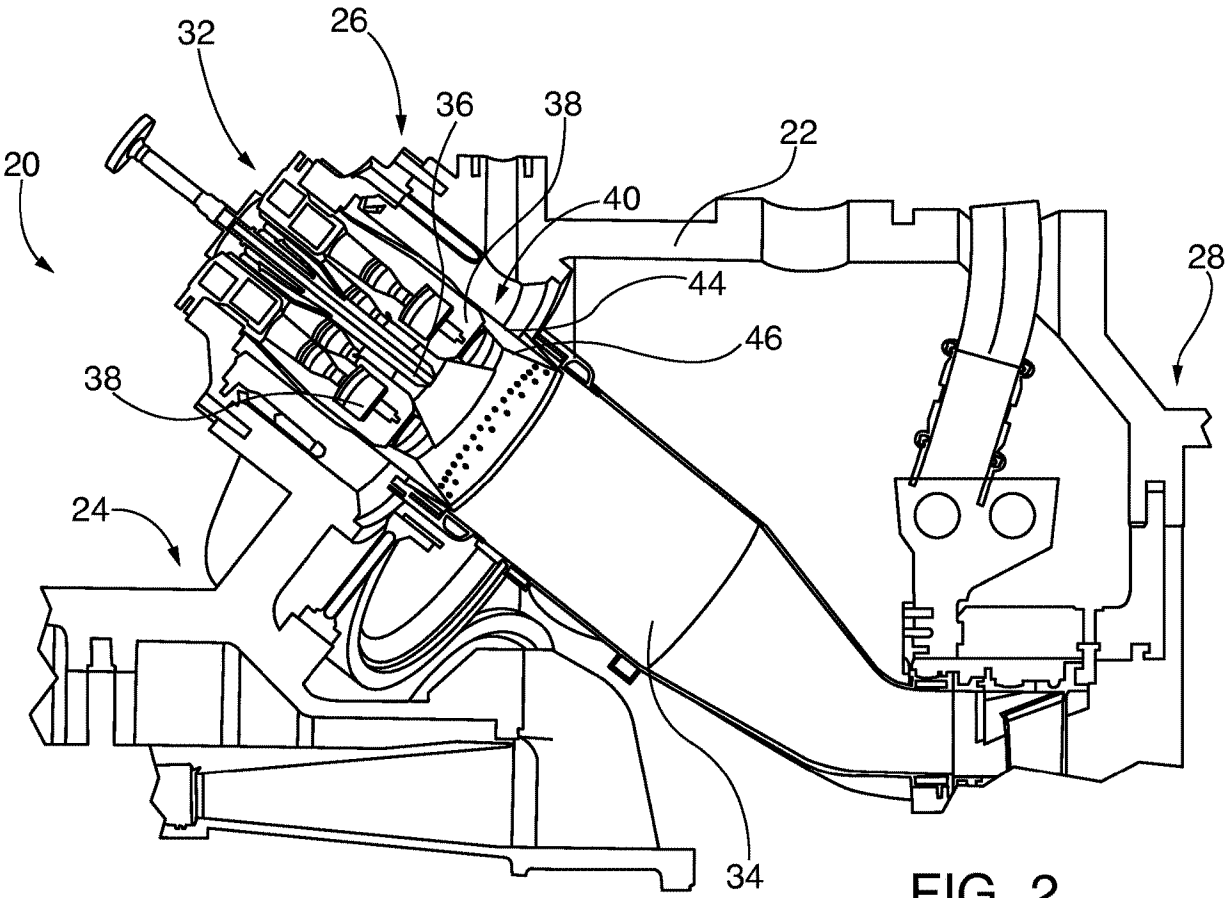

FIGS. 1 and 2 show a gas turbine engine 20, having a gas turbine casing 22, a compressor section 24, a combustor section 26, a turbine section 28 and a rotor 30. One of a plurality of basket-type combustors 32 is coupled to a downstream transition 34 that directs combustion gasses from the combustor to the turbine section 28. As shown in greater detail in FIG. 3, the combustor 32 has a known pilot nozzle and a plurality of circumferentially arrayed main nozzles 38 within a combustor basket 40. The combustor basket distal downstream end 42 interfaces with the transition 34.

Figure 3:
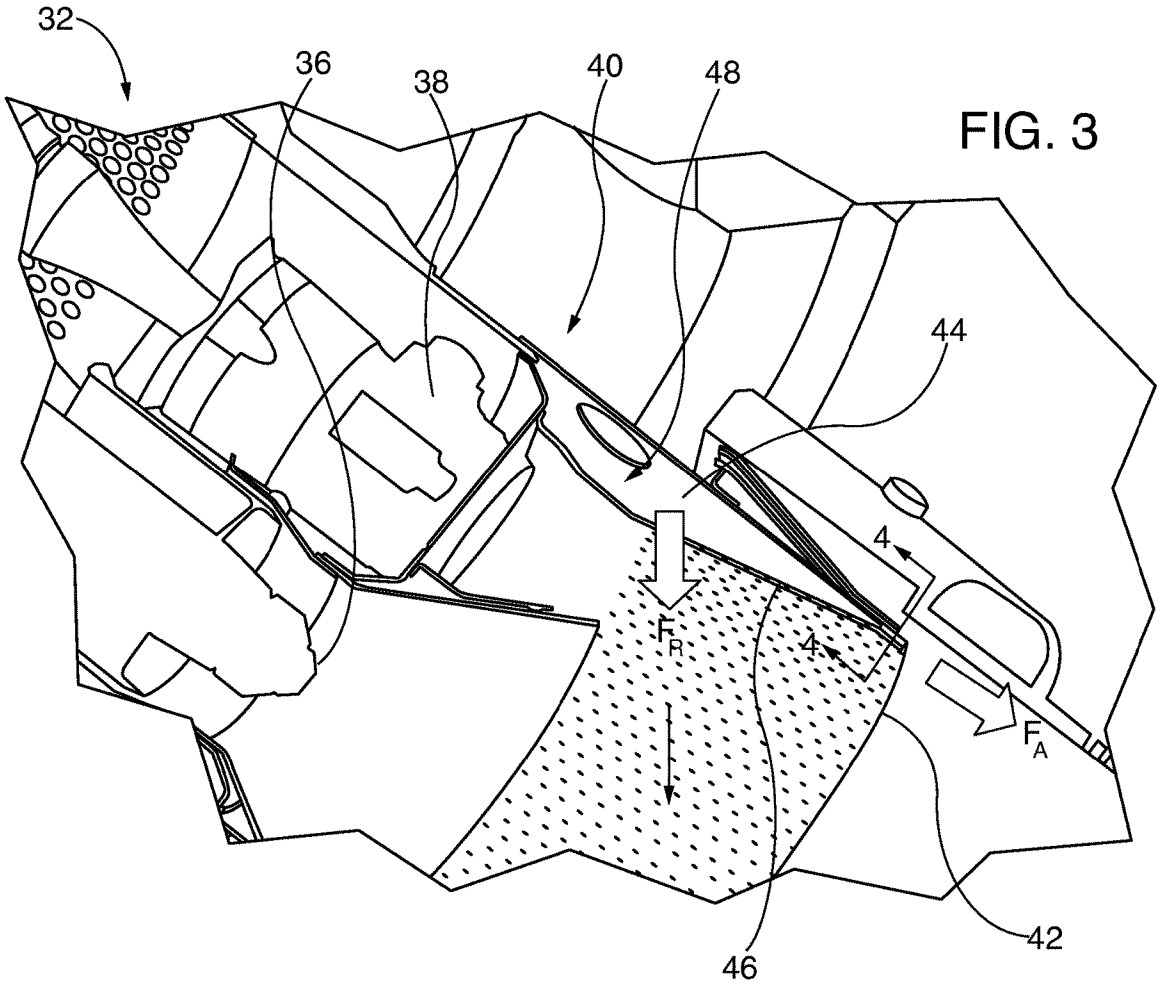
FIG. 3 is a perspective end view of the combustor basket of FIGS. 1 and 2, including a detailed view of the distal tip gap formed between the basket's inner and outer liners.
Figure 5:
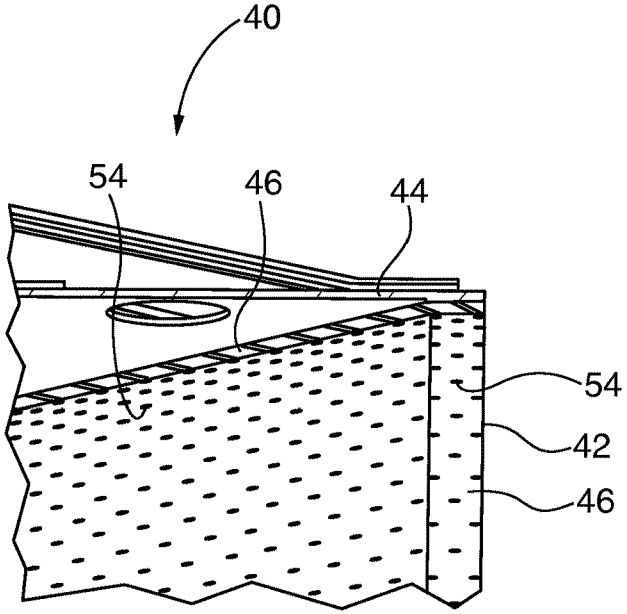
FIG. 5 is a detailed axial cross sectional view of the inner and outer liner interface at a distal tip of the combustor basket of FIG. 2, showing abutment of platefins against an outer circumferential surface of a corresponding inner liner.
Figure 4:
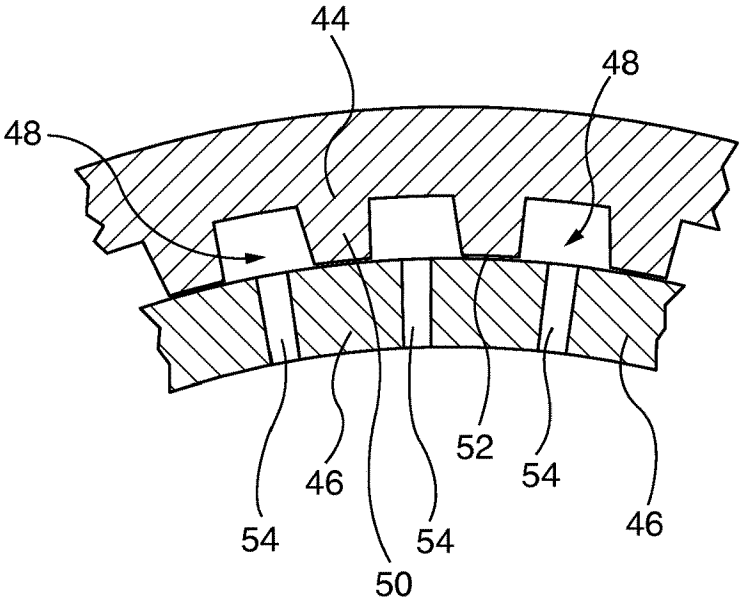
FIG. 4 is a radial cross sectional view of the combustor basket outer and inner liners, taken along 4-4 of FIG. 3, showing abutment of outer liner platefins against an outer circumferential surface of the inner liner between the inner liner effusion cooling through holes.

Referring to FIGS. 3-5, the exemplary combustor basket 40 has nested outer 44 and inner 46 liners, respectively having axial length, as well as radially spaced downstream distal ends that terminate at the combustor basket downstream end 42. The outer 44 and inner 46 liners form a cooling gap or cavity 48 between their respective opposed surfaces. At the combustor basket distal tip 42 interface the radial cooling gap 48 is maintained by radially inwardly projecting platefins 50, which are formed equidistantly apart from one neighboring platefins 50 on an inner circumferential surface of the outer liner 44, for abutting contact with the inner liner 46. The platefins 50 have a generally spline-like profile to facilitate axial cooling airflow through the radial cooling gap 48 between the outer and inner liners 44, 46. Other platefins cross sectional profiles, such as triangular or trapezoidal profiles may be substituted for the generally rectangular cross sectional profile shown in FIG. 4. The platefins 50 optionally have distal tip 52 curved profiles that conform with an outer circumferential profile of the inner liner 46. The exemplary embodiment platefins 50 shown in FIGS. 4 and 5 are directly formed in the outer liner 44 by cutting or pressing metal forming operations. Alternatively, the platefins 50 can be formed in a separate component that is welded, fused or otherwise coupled to the outer liner 44.

Cooling air flows axially through the gap 48 formed between the outer 44 and inner 46 liners, as shown schematically by the arrow $F_A$ shown in FIG. 3. Optionally the inner liner 46 defines through-holes 54 along at least a portion of its axial length, for passage of effusion cooling air in the radial direction, as shown schematically in FIG. 3. At the downstream distal end 42 of the combustor basket 40 the inner liner through holes 54 are arrayed in airflow gaps 48 between the platefins 50. Directed passage of cooling air via the through holes 50 at the downstream distal end 42 helps to reduce thermal erosion of the combustor basket 40. Placement of the platefins 50 on the relatively cooler outer liner 44 rather than the known conventional placement of dimples on the relatively hotter inner liner 46 reduce risk of structural collapse of the platefins that might otherwise inadvertently restrict or close off cooling airflow gaps 48 near the collapsed portion. Added potential hotspots in the combustor basket distal end 42 would further increase risk of thermal damage to the combustor basket 40.

Although various embodiments that incorporate the teachings of the present invention have been shown and described in detail herein, those skilled in the art can readily devise many other varied embodiments that still incorporate these teachings. The invention is not limited in its application to the exemplary embodiment details of construction and the arrangement of components set forth in the description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

What is claimed is:

1. A gas turbine engine combustor basket apparatus, for passage of combustion gas there through, comprising:

nested outer and inner liners, respectively having axial length, upstream proximate ends, and radially spaced downstream distal ends, the respective outer and inner liners forming a gap between the outer and inner liners for passage of cooling air, wherein the upstream proximate ends are upstream of a fuel nozzle of the combustor basket apparatus; and wherein the inner liner comprises an outer circumference surface within the gap and wherein the outer liner comprises platefins formed on the outer liner and projecting radially inwardly from an inner circumferential surface of the outer liner and towards the outer circumference surface of the inner liner for maintaining the cooling air passage gap, each platefin being connected to the outer liner to reduce thermal erosion and distortion, wherein the inner liner has effusion cooling through holes in its outer circumference, oriented in the gap between the platefins so that cooling air passes through the effusion holes from the gap formed between the outer and inner liners into an interior of the combustor basket apparatus.

2. The apparatus of claim 1, the platefins aligned axially within the outer liner inner circumferential surface.

3. The apparatus of claim 1, the platefins having distal tip profiles conforming to a profile of the outer circumferential surface of the inner liner.

4. A gas turbine engine apparatus, comprising:

a turbine casing, including a rotatable rotor as well as compressor, combustor and turbine sections;

the combustor section comprising a combustor basket having:

a plurality of nested outer and inner liners, respectively having axial length, upstream proximate ends, and radially spaced downstream distal ends, a gap is formed between the respective outer and inner liners for passage of cooling air, wherein the upstream proximate ends are upstream of a fuel nozzle of the combustor basket;

wherein each inner liner comprises an outer circumference surface within the gap and wherein each outer liner comprises a plurality of platefins formed on the each outer liner and projecting radially inwardly from an inner circumferential surface of the each outer liner and towards the outer circumference surface of each inner liner for maintaining the cooling air passage gap and to reduce thermal erosion and distortion, wherein each inner liner having effusion cooling through holes in each inner liner outer circumference, oriented in the gap between the platefins so that cooling air passes through the effusion holes from the gap formed between the outer and inner liners into an interior of the combustor basket.

5. The apparatus of claim 4, the platefins aligned axially within each respective outer liner inner circumferential surface.

6. The apparatus of claim 4, the platefins of each outer liner having distal tip profiles conforming to a profile of the outer circumferential surface of each corresponding inner liner.

7. The apparatus of claim 4, wherein the effusion cooling through holes in each inner liner outer circumference, are oriented along at least a portion of a remaining axial length of each inner liner.

8. A method for cooling a gas turbine engine combustor basket, for passage of combustion gas there through, comprising:

providing nesting outer and inner liners, respectively having axial length, upstream proximate ends, and radially spaced downstream distal ends, the respective outer and inner liners forming a gap between the outer and inner liners for passage of cooling air, wherein the upstream proximate ends are upstream of a fuel nozzle of the combustor basket; and forming radially inwardly projecting platefins on an inner circumferential surface of the outer liner and towards an outer circumference surface of the inner liner for maintaining the cooling air passage gap and to reduce thermal erosion and distortion;

installing the combustor basket into a gas turbine combustor; and operating the engine, wherein the inner liner has effusion cooling through holes in its outer circumference, oriented in the gap between the platefins so that cooling air passes through the effusion holes from the cooling air passage gap formed between the outer and inner liners into an interior of the combustor basket.

9. The method of claim 8 further comprising forming the platefins in the outer liner in axial alignment therewith.

10. The method of claim 8, further comprising forming the effusion cooling holes in the inner liner outer circumference along at least a portion of its remaining axial length.

* * * * *